US005169003A

United States Patent [19]

Traupman

[11] Patent Number: 5,169,003

[45] Date of Patent: Dec. 8, 1992

[54] PLANISTER

[76] Inventor: James P. Traupman, P.O. Box 88, Sellersville, Pa. 18960-0088

[21] Appl. No.: 830,225

[22] Filed: Jan. 31, 1992

[51] Int. Cl.[5] ..... B65D 41/08

[52] U.S. Cl. ..... 206/524.8; 215/276; 215/277; 215/335; 215/352; 220/256

[58] Field of Search ..... 206/524.8; 215/273, 215/274, 276, 277, 335, 352; 220/256

[56] References Cited

U.S. PATENT DOCUMENTS

| | | | |
|---|---|---|---|
| 406,542 | 7/1889 | Silva | 215/335 |
| 714,719 | 12/1902 | Long, Jr. | 215/274 |
| 727,808 | 5/1903 | Knowlton | 215/276 |
| 1,134,069 | 3/1915 | White | 215/276 |
| 1,683,388 | 9/1928 | Hammer | 215/277 |
| 2,449,014 | 9/1948 | Shaffer | 215/276 |
| 2,685,316 | 8/1954 | Krasno | 206/524.8 |
| 4,093,094 | 6/1978 | Smalley et al. | 215/276 |
| 4,122,964 | 10/1978 | Morris | 215/276 |
| 4,466,553 | 8/1984 | Zenger | 206/524.8 |

FOREIGN PATENT DOCUMENTS

| | | | |
|---|---|---|---|
| 0111764 | 10/1940 | Australia | 215/276 |
| 0460781 | 12/1913 | France | 215/335 |
| 0015916 | 7/1885 | United Kingdom | 215/276 |

*Primary Examiner*—Jimmy G. Foster

[57] ABSTRACT

A vacuum-sealed shipping/storage system based on rigid cylinders of plastic or metal, of various diameters, permanently sealed at one end, with the opposite end having removable, double-sealed vacuum lids. In the case of three inch PVC pipe, the first, or primary lid is a common wide-mouth mason jar lid. Larger cylinders use a similar device. Over each primary lid, a single cap of molded or machined plastic or metal is threaded to a permanently affixed threaded collar, such threaded collar being fastened to the outer surface of the cylinder. Between this secondary cap and collar is found an O-ring, of common design, for the purpose of maintaining a secondary vacuum seal should the primary seal become loosened by shifting contents. Removal of both primary lid and secondary cap exposes the entire inner diameter of the cylinder for insertion or removal of materials. For storage-only applications, where little or no movement of the cylinder is anticipated, the primary lid alone will maintain course vacuum.

6 Claims, 7 Drawing Sheets

PLANISTER

BACKGROUND OF THE INVENTION

1. Field of the Invention

This invention is a plastic vacuum canister (referred to as a PLANISTER from this point onward) which relates to the technology of vacuum packaging in rigid, cylindrical containers of plastic or metal. The vast majority of vacuum packages in use today, especially for consumer goods, are that of "disposable" or "throw-away type". The PLANISTER provides an economical method of applying recyclable vacuum containers to a wide variety of uses. Also, the PLANISTER provides a secondary vacuum seal using readily-available materials. Further, the PLANISTER is intended to provide a moisture-proof container for both shipping and/or storage of various materials.

2. Description of the Prior Art

| | |
|---|---|
| R. B. Waite | Patent 1,509,916 (Sep. 1924) |
| Thomas J. Rossi | Patent 3,943,987 (Mar. 1976) |
| Anthony & Richard Iavarone | Patent 4,093,009 (Jun. 1978) |
| Ronald J. Corn | Patent 4,591,055 (May 1986) |
| Gordon Geasland | Patent 4,779,736 (Oct. 1988) |

It is known in the prior art that numerous patents have been issued for vacuum-sealing cylindrical devices of various materials. In the case of GEASLAND, U.S. Pat. No. 4,779,736 is demonstrated a means of sealing thermoplastic pipe at both ends and providing an aperture at one end for inserting and removing material. The GEASLAND device is very effective in providing a seal that is both liquid-tight and applicable to a wide-variety of uses. However, in each claim of the GEASLAND Patent, the aperture so provided is smaller than the cross-sectional area of the cylinder being used. This is to say that, for example, three-inch PVC pipe using the GEASLAND method will have a usable opening of less that three inches for inserting and removing material. Also, the necessity of heat-sealing thermoplastic pipe is not a readily available means for the typical consumer. Such heat-sealing is better suited to commercial and/or industrial users. The GEASLAND Patent does not provide the equivalent of a secondary O-ring vacuum seal as is provided with the PLANISTER. The GEASLAND Patent, by description, suggests cylinder lengths measured in feet (to make the process practical) whereas PLANISTERS are suitable in lengths of from just a few inches to ten feet in length.

In the Case of CORN, U.S. Pat. No. 4,591,055 there is the use of a thermoplastic overwrap that is not necessary with the PLANISTER. The PLANISTER does not provide the semaphore "loss of vacuum" signal as is provided with the CORN Patent, however, the PLANISTER provides a secondary vacuum seal via O-ring that is not present in the CORN device.

The vacuum devices for IAVARONE (et al), U.S. Pat. No. 4,093,009 refer to flexible containers, whereas the PLANISTER is specifically intended for resilient materials.

In the case of ROSSI, U.S. Pat. No. 3,943,987 there is the use of an evacuation valve on the vacuum-sealed device proper, which is not necessary with the PLANISTER. Such device is located at the vacuum pumping source instead. Also, the ROSSI device has no secondary O-ring vacuum seal as is found on the PLANISTER.

The secondary O-ring seal is also not present with U.S. Pat. No. 1,509,916 granted to R. B. WAITE (September 1924).

SUMMARY OF THE INVENTION

It is the intent of this invention to provide, and it does provide, a method of vacuum-sealing cylindrical devices of various materials in a manner that is perceived to be an improvement in the art.

A PLANISTER is believed to be the first device to maintain a course vacuum in three inch (trade-size) polyvinyl chloride (hereafter PVC) pipe with a wide-mouth mason jar lid. This simple technique, combined with secondary seal, is the basis for this invention. Using techniques described herein, it will be easier to provide vacuum packaging for a greater number of users than in the past because of both the simplicity of the methods used as well as the ready availability of needed materials. Using plastic or metal cylinders in place of glass will permit vacuum-packed shipping containers without the dangers of broken glass. Also, the use of a secondary O-ring seal will maintain vacuum integrity during shipping and handling procedures. The main drawback to using thermoplastic PVC pipe for PLANISTERS is that PVC does not lend itself to long-term exposure to ultraviolet light. The simple application of a paint or other protective coating should overcome this limitation. Also, the PLANISTER can be manufactured of metal for use in direct sunlight.

A PLANISTER is a rigid cylinder of plastic or metal, permanently sealed at one end with the opposite end fitted with two-stage reusable caps. These removable/reusable caps are so arranged as to permit ease of vacuuming as well as expose the entire inside diameter of the cylinder for insertion or removal of material.

The PLANISTER may be used with known jar sealers which seal jars while drawing a vacuum therein.

Another means of producing vacuum in a any of the devices in FIGS. 1 to 7 is by reducing the inside diameter of a curved end-cap from four-inch PVC pipe. Using such an "off-the-shelf" four inch PVC pipe cap, it is an uncomplicated procedure to install a threaded stem, one eighth to one quarter NPT, into the belled area of the pipe cap. This threaded stem is then connected, via hose, to a vacuum pump with a vacuum gauge in line for determining proper degree of vacuum. Reduction of the four inch pipe cap inner diameter is first completed by gluing a short stub of four inch PVC pipe into the pipe cap. A large rubber or synthetic gasket is then fabricated to provide a final diameter of three and one quarter inches to seal against the outer diameter of three inch PVC pipe.

Starting with a base material of PVC pipe, it is possible to develop a course vacuum of twenty-five inches mercury with only three basic items: (1) A cylinder of three-inch inside diameter PVC pipe; (2) An end-cap for this same pipe and; (3) A single wide-mouth mason jar lid. All three of these items are readily available through retail purchase.

Additionally, there are incidental needs for such items as rubber bands and PVC pipe cement necessary to produce a PLANISTER from off-the-shelf PVC pipe. Such materials are not necessary when using a PLANISTER manufactured specifically for the purpose.

Ease of use with a PLANISTER will allow homeowners, industry, business and the military to vacuum seal such diverse items as cereal grains to aircraft cleco-fasteners.

Manufacturing a PLANISTER from off-the-shelf parts consists of gluing an end-cap to a cut length of three-inch PVC pipe. The opposite end of this same pipe (now the "lid" end) must be cut perpendicular to the length so as to ensure a true circle. This "lid" end is filed smooth and a wide-mouth mason jar lid is placed over the open pipe.

Place three (size 84) rubber bands concentrically around the lid end of the pipe, with the outer-most rubber band in a half-overlap above the first two. The jar sealer may then be placed over the mason jar lid (against the rubber bands) and a vacuum pumped from the pipe using the jar attachment.

More conveniently, PLANISTER's specifically manufactured for the purpose will have one end of the cylinder (or pipe) factory sealed. This eliminates the need for using PVC cement. Also, the lid end of a PLANISTER is provided with a factory-installed external thread for the purpose of accepting a cap over the mason jar lid. With the mason jar lid vacuum sealed to the pipe, this cap is threaded over top of the lid and secured against the external thread. Between this secondary cap and thread is an O-ring of one-eighth inch thick neoprene material. This O-ring, so located, will maintain a vacuum within the PLANISTER should the primary mason jar lid work loose from shifting material inside. The use of O-rings in similar applications is well established and not detailed further here.

DETAILED DESCRIPTION

CONTAINER FOR FIGS. 1 AND 2

Figure 1:
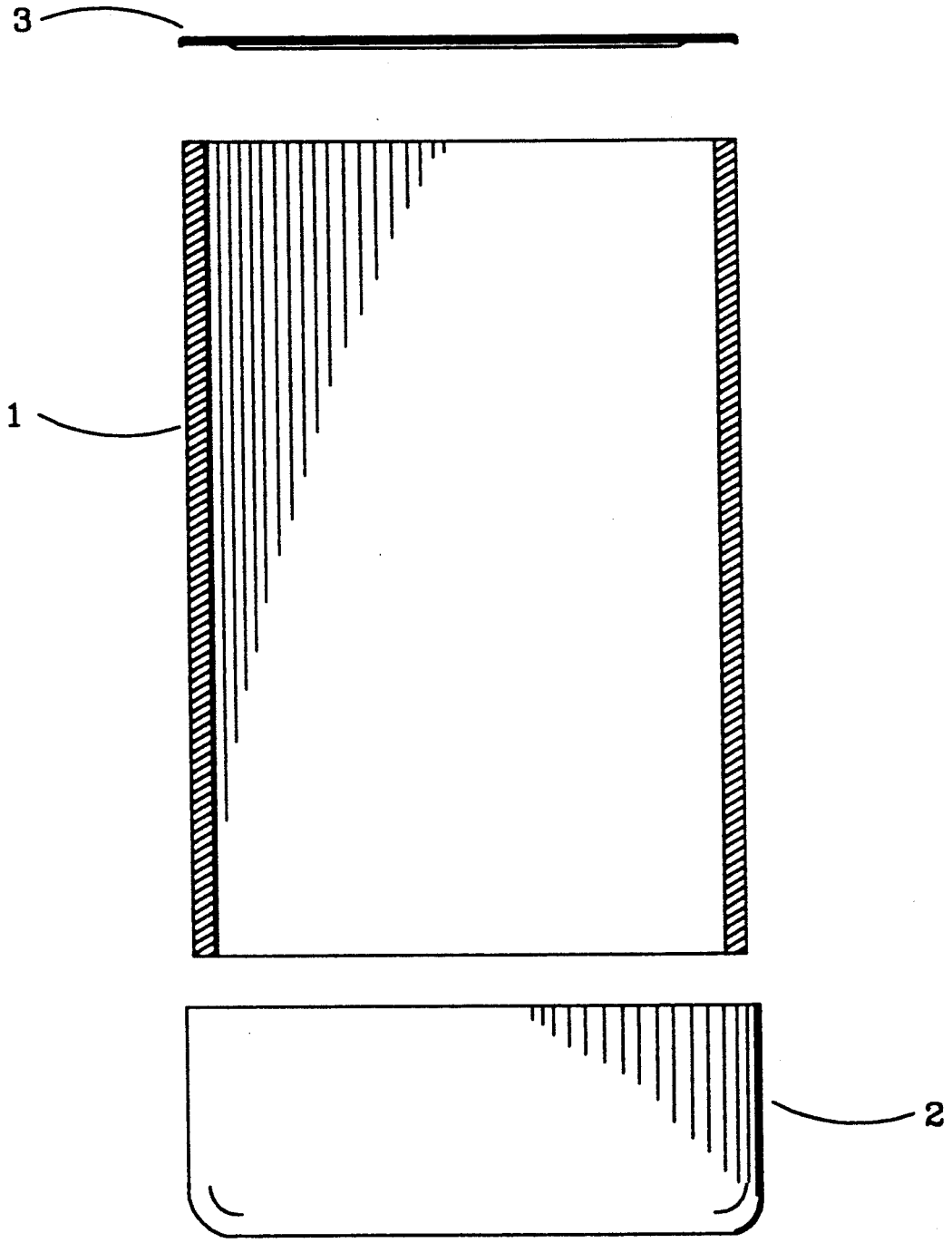
FIG. 1 is a full-scale, exploded view. Three inch PVC pipe 1 is shown in section view with end-cap 2 and mason jar lid 3 in side view.

FIG. 1 is an exploded view of those components necessary to maintain vacuum in three inch PVC pipe. Because there are only three elements in FIG. 1, no brackets are detailed showing relation of parts as this should be obvious. Details consist of a cut length of three inch PVC pipe 1, a flat-bottomed PVC pipe end-cap 2 and a wide-mouth mason jar lid 3.

In FIG. 1, consider the end of pipe 1 closest to cap 2 as the "bottom" with the opposite (top) end considered the "lid" end. The bottom of pipe 1 is permanently sealed to cap 2 using readily available PVC cement. Such cement is available where pipe 1 and cap 2 were purchased. There is no need for special attention to the bottom cut for this end of the PVC pipe beyond that necessary to ensure a good fit between pipe 1 and cap 2.

The opposite (lid) end of pipe 1 requires that it be cut perpendicular to its length. This is to ensure that a true circle is formed for acceptance of lid 3. Such cutting of pipe 1 may be completed with a radial arm saw, miter box or similar cutting device capable of ensuring a perpendicular cut. After cutting, the lid end of pipe 1 must be filed smooth; continuing to ensure that the plane of the opening remains perpendicular to the length of the pipe.

With cap 2 properly cemented to pipe 1 and the opposite end of pipe 1 cut and smoothed, the assembly of pipe 1 and cap 2 is ready to accept lid 3.

For convenience, a known jar vacuum sealer (with a wide mouth jar sealer attachment) is used to seal a vacuum in the assembly. Without such a vacuum sealer, it is possible to modify a four inch (PVC) round-bottomed pipe cap for this purpose.

Place three size 84 rubber bands around the upper end of pipe 1, approximately one-half inch from the lid end. Arrange the first two rubber bands one on top of the other (concentrically). The third rubber band is positioned in a half overlap; forming a taper between all three rubber bands and the lid end of pipe 1. Place the wide mouth mason jar lid on top of pipe 1, then place the wide mouth vacuum jar sealer over lid 3, against the rubber bands. Carefully press down on the vacuum jar attachment and vacuum lid 3 to pipe 1 as if a mason jar. One may employ a known vacuum gauge for determining the proper amount of vacuum; however, it is possible to listen to lid 3 "snap in", as is common during hot-pack canning at processes. This ensures at least a twenty-five inch mercury vacuum exists inside the assembly comprising parts 1, 2 and 3.

CONTAINER FOR FIGS. 3 AND 4

Figure 3:
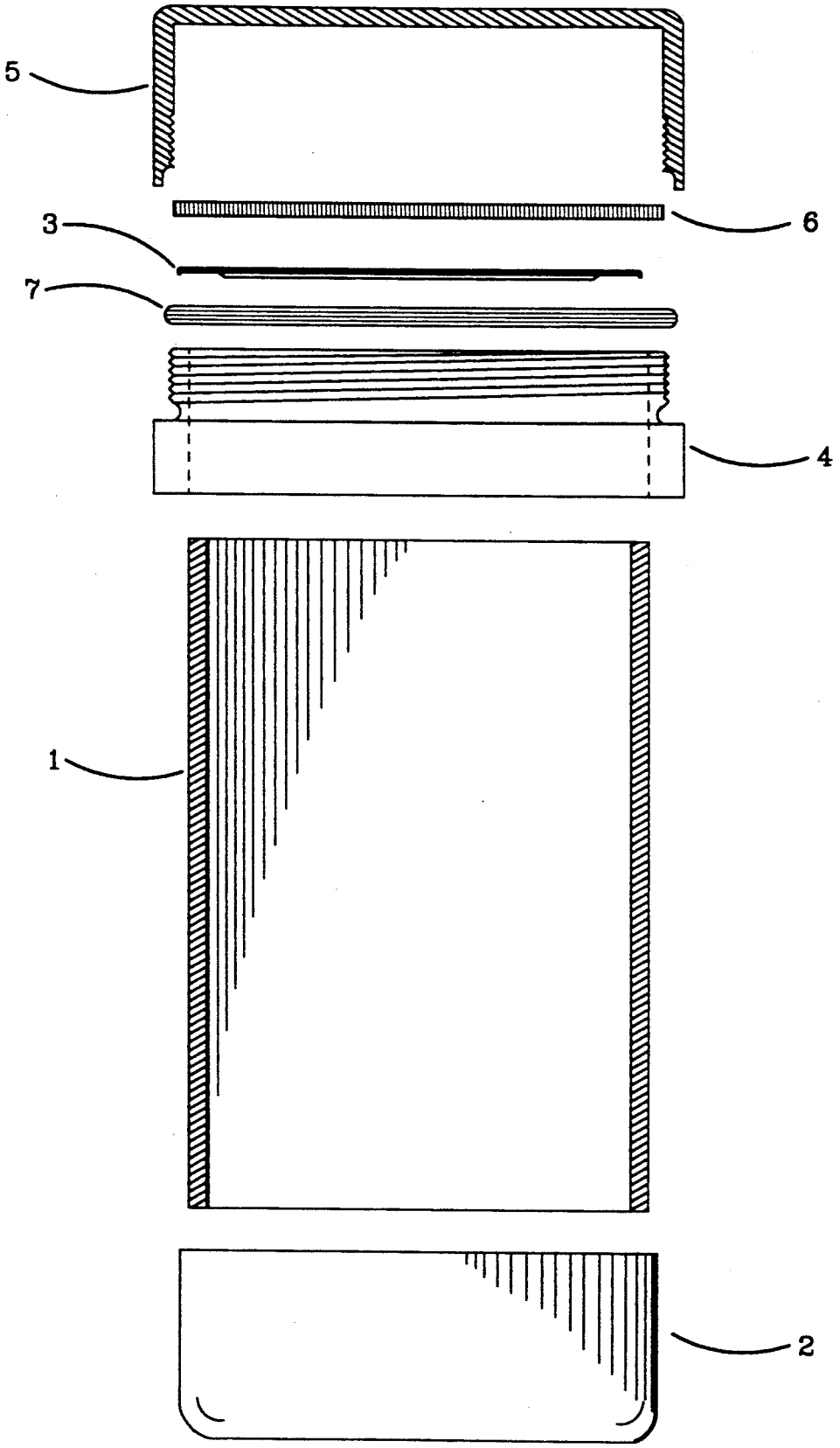
FIG. 3 is an exploded side view of a PLANISTER based on individual components from three inch PVC pipe. Details 1 and 5 are in section view.

FIG. 3 is a full-scale exploded view of those details necessary to fabricate a three inch PLANISTER from manufactured parts. "Manufactured Parts", in this instance, refer to a machined or injection-molded collar 4, with separate O-ring 7 and a machined or injection-molded cap 5 with gasket 6.

"Three Inch PLANISTER" refers to the inside diameter of PVC pipe used. PVC pipe 1, pipe end cap 2, and mason jar lid 3 are the same as in FIGS. 1 and 2. As in those two previous FIGS., there are no brackets showing the relationship of parts in FIG. 3 because there are so few parts and their relationship is readily obvious in FIG. 4. Gasket 6 and O-ring 7 may be fabricated from Neoprene, Buna-N or other materials.

Figure 2:
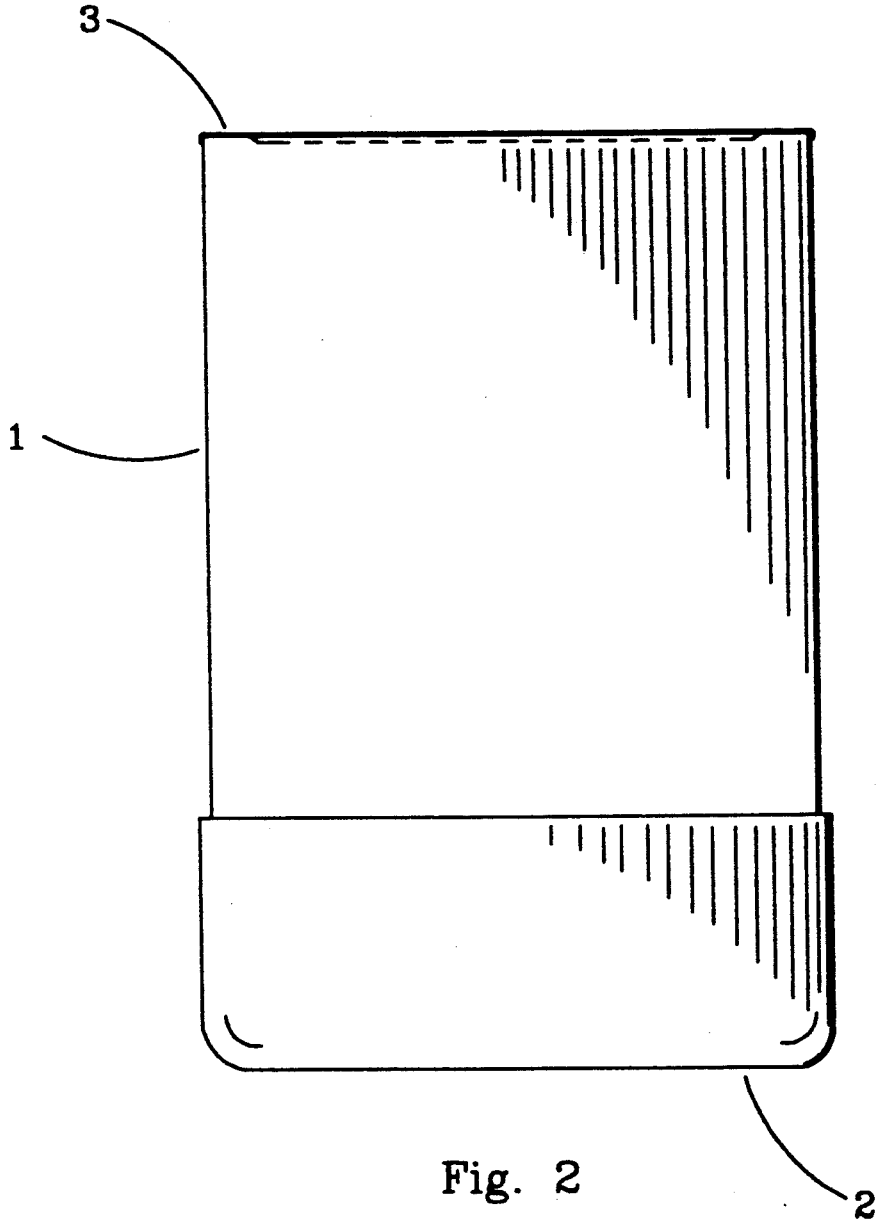
FIG. 2 is the assembled side elevation of those items detailed in FIG. 1.
Figure 4:
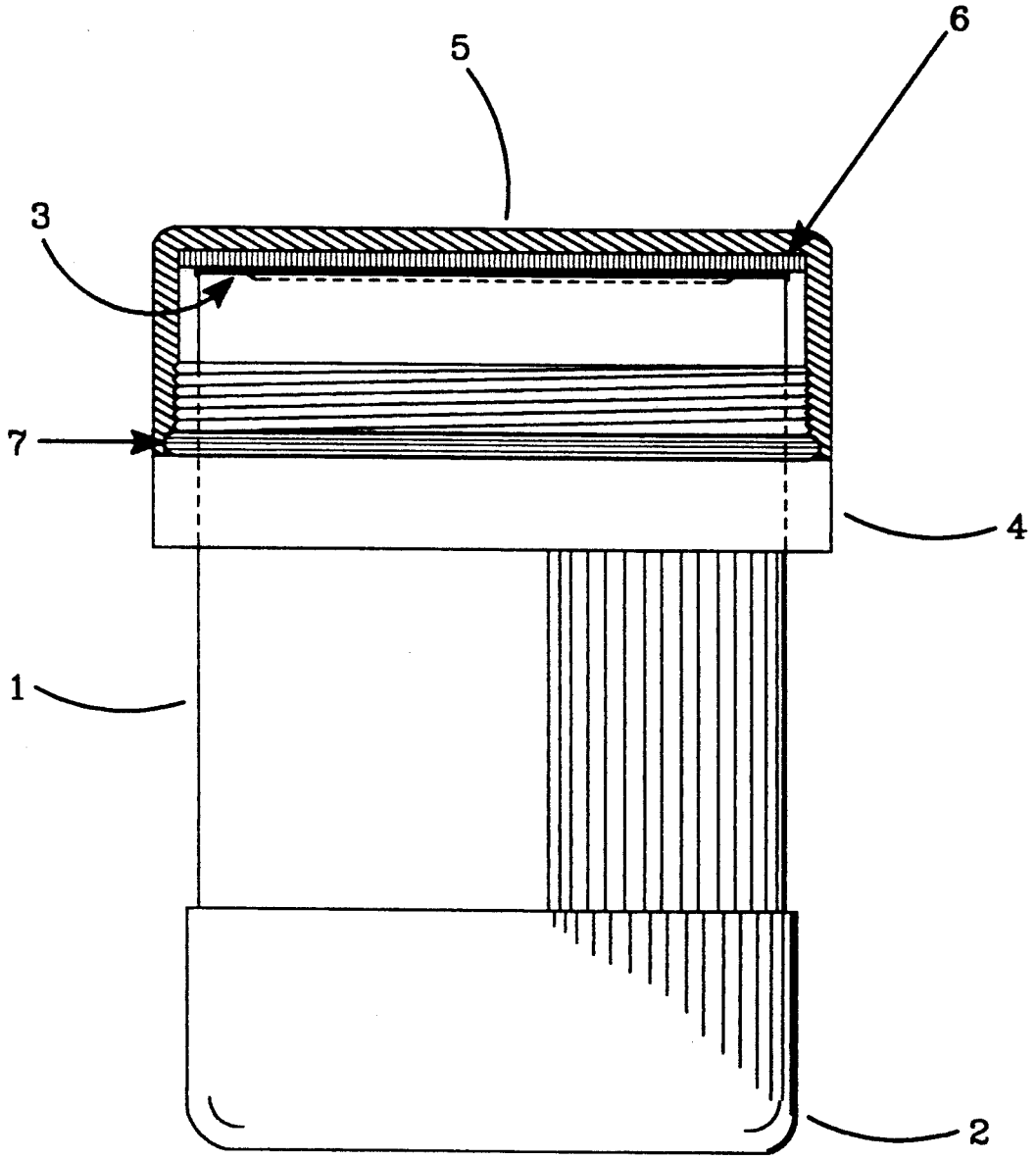
FIG. 4 is the assembled view of the items in FIG. 3 with cap 5 in section view.

FIGS. 3 and 4 are considered an expansion of the device fabricated in FIGS. 1 and 2 by introducing the secondary O-ring seal. Starting with the device fabricated in FIGS. 1 and 2, remove lid 3 (causing loss of vacuum) from pipe 1. This step is necessary to install collar 4. Hold collar 4 around pipe 1, then return lid 3 to the top of 1. This step is necessary because lid 3 is slightly larger than the outside diameter of pipe 1 while the inside diameter of collar 4 is intended to be a tight fit around the outside of pipe 1.

With lid 3 on top of pipe 1 and collar 4 being held in place, thread cap 5 (with gasket 6) onto collar 4. Press the assembly of parts 4-5-6 down against lid 3 and place a mark on pipe 1 at the lower side of collar 4. This mark is a "glue line" and determines where the collar collar 4 must be located to ensure a tight fit. O-ring 7 is not needed for this step.

Remove the assembly 4-5-6 (which will also remove lid 3) from pipe 1 and set aside all but collar 4. Using PVC cement or any type of adhesive suitable for the purpose, glue the collar 4 to pipe 1 at the mark just located. Allow collar 4 to set per adhesive manufacturer's instructions. Return lid 3 to PVC pipe 1 and restore vacuum as per instructions for FIGS. 1 and 2.

With vacuum thus secured, place O-ring 7 around collar 4 at the indentation provided just below collar threads. Fasten cap 5 to collar 4 by threading the two together. Finished product at this stage is a PLANISTER fabricated from individual components. It must be noted that 5 may be removed from collar 4 without loss of vacuum. The addition of parts 4, 5, 6, and 7 protect lid 3 from internal and external forces, such as those encountered with shipping and/or handling of shipping containers. For storage-only applications, only mason jar lid 3 is necessary to maintain vacuum inside pipe 1.

CONTAINER FOR FIGS. 5, 6 AND 7

Figure 5:
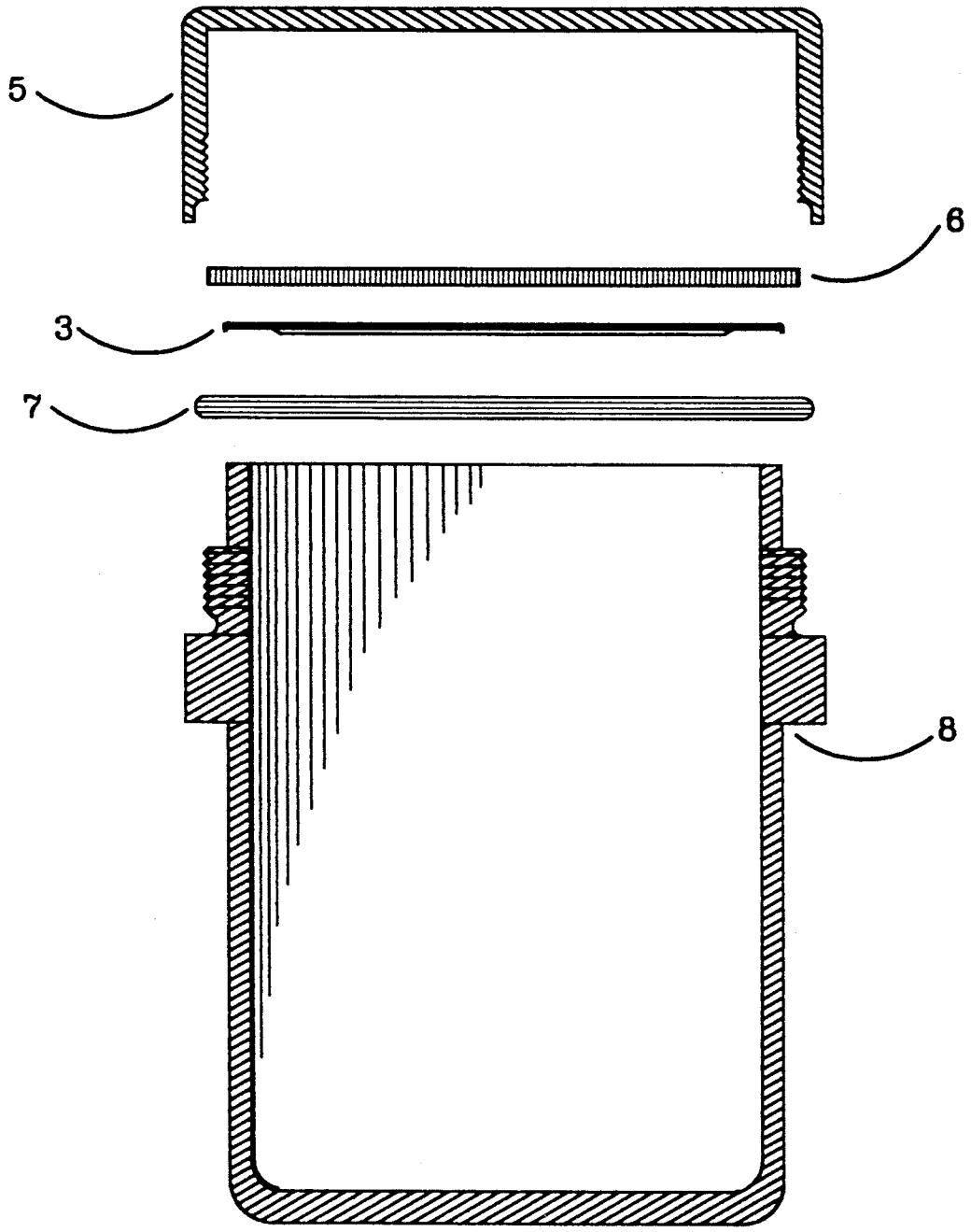
FIG. 5 is a full-scale, exploded side view of a PLANISTER specifically manufactured for the purpose. Details 5 and 8 are in section view.
Figure 6:
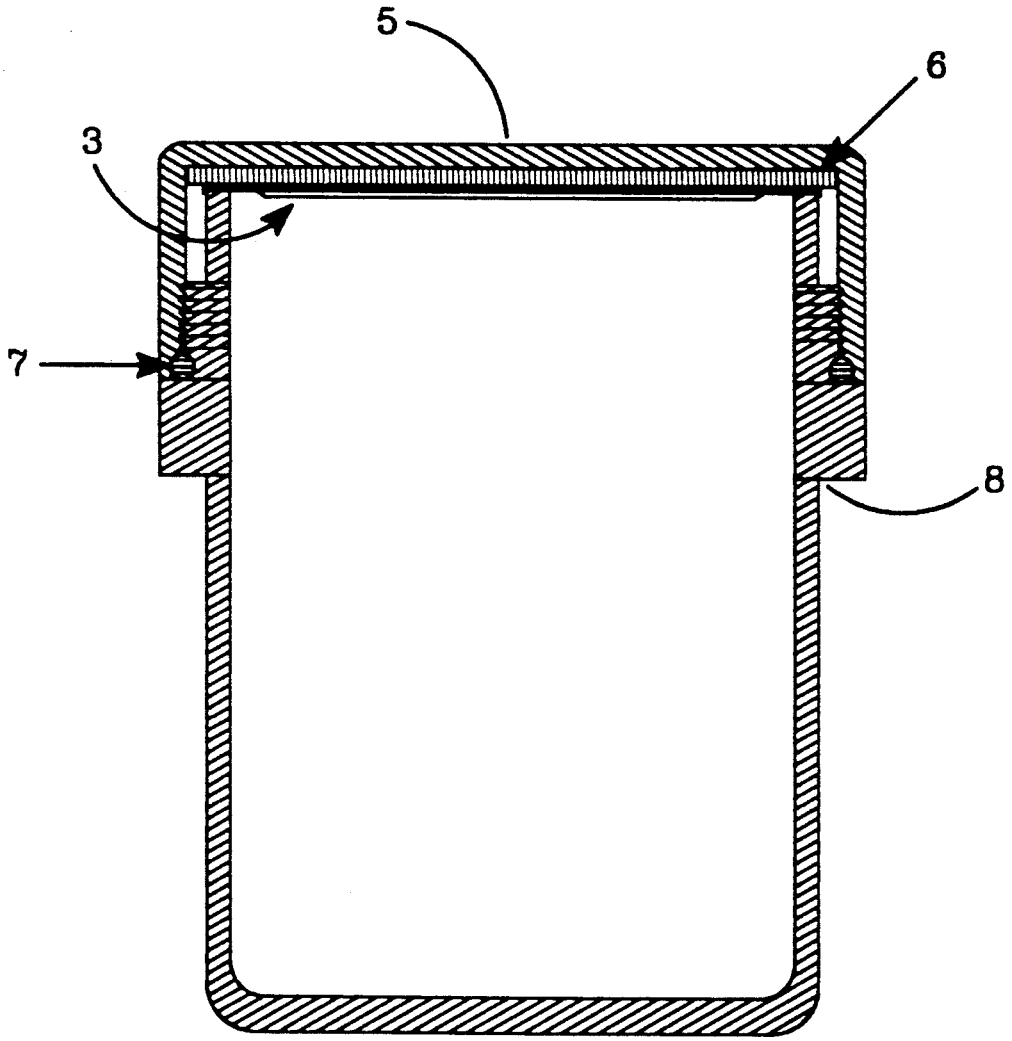
FIG. 6 is the assembled section view of those items detailed in FIG. 5.
Figure 7:
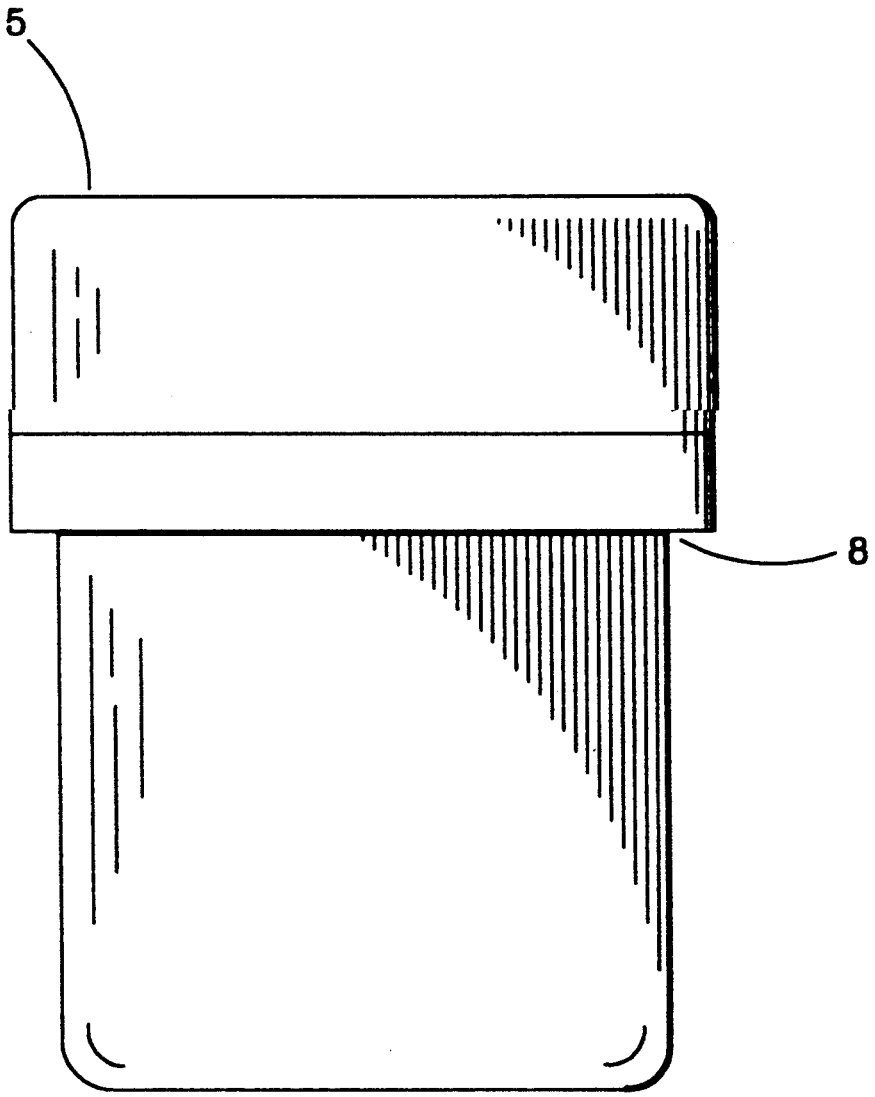
FIG. 7 is a full-scale side elevation of FIG. 6.

FIGS. 5, 6 and 7 detail a PLANISTER specifically manufactured for the purpose. "Specifically manufactured for the purpose" means that cylinder 8 is no longer PVC pipe, but a device of like chemical composition while differing in physical characteristics. Note per FIG. 5 that one end of cylinder 8 is molded over (i.e., sealed); eliminating the need of a pipe cap. Such a process is uncomplicated and may be manufactured through a variety of processes. Further, the opposite end of cylinder 8 has an external collar and thread molded in, eliminating the need of a separate collar, (4 from FIGS. 3 and 4). For use with a jar vacuum sealer, cylinder 8 could be manufactured with a slight taper above the external threads. This taper would permit ready acceptance of the vacuum jar sealer or other device for vacuum sealing the PLANISTER. In lieu of such taper as described, a separate, flexible collar could be manufactured to be temporarily placed around cylinder 8, just above the external threads. This temporary collar would serve the same purpose in that its shape would be tapered, from thin near the top of cylinder 8 to wider near the external threads of cylinder 8. Such a tapered collar would permit easier vacuum sealing of the PLANISTER. Also, a simple tab could be manufactured in cylinder 8, just above the external threads, for allowing a coin (or other device) to remove lid 3 from cylinder 8. In the case of mason jars, this procedure is accomplished by using a typical "can opener" to lift lid 3 from the jars. However, since the threads of cylinder 8 are located farther from lid 3 than in mason jars, some consideration must be given for removing lid 3 to access contents of a PLANISTER. Some individuals can merely use opposing thumbs to lift lid 3 from cylinder 8, however, most users will find this too difficult. A metal insert, in the shape of a tab, could be manufactured into the wall of cylinder 8 as an aid in removing lid 3.

It should be readily apparent that cylinder 8 is a unique device. FIGS. 5, 6 and 7 are configured around cylinder 8 having an inside diameter of three inches with a wall thickness of one-eighth inch (taper is not detailed). It should also be obvious that such a manufactured product as cylinder 8 will then readily accept the cap 5 with gasket 6 and O-ring 7 as in FIGS. 3 and 4. The finished product, consisting of parts 3, 5, 6, 7, and 8 will be a PLANISTER specifically manufactured for the purpose. FIG. 5 is an exploded view of such a PLANISTER. FIG. 6 is the assembled section view detailing internal form and fit. FIG. 7 is the side elevation of a finished PLANISTER of three inch inside diameter.

Manufacture of cylinder 8 for the vacuum cylinder detailed above will provide a new method of reusable vacuum packaging for the average consumer. Since the PLANISTER is suitable to small sizes, it will allow households to vacuum seal such diverse items as cereal, rice, pasta and other grains in long cylinders. Industrial applications are unlimited. However, it is the recyclability of PLANISTER's that will provide the greatest benefit. If approved for food storage, PLANISTER's could be used for frozen foods, in small to "family sized" containers. Purchasers of foodstuffs in PLANISTER's would pay a deposit at the retail level. Such deposit would be credited back to the consumer at the next purchase.

Note in FIG. 7 that only two surfaces are exposed; that of cap 5 and cylinder 8. Out of sight, and thus protected, are lid 3, and O-ring 7. Cap 5 also protects the rim of cylinder 8. The air gap depicted between cylinder 8 and cap 5 is exaggerated for illustration purposes. This gap will actually be less after manufacture of components.

What is claimed is:

1. A rigid cylindrical container having a vacuum therein, comprising:

a pipe having a first end and a second end and an outer surface, a cap fastened to said first end, a lid closing said second end providing a primary vacuum seal, a threaded collar affixed to the outer surface of said pipe near said second end, a threaded cap having an underside and being threadably engaged to said collar, an O-ring being positioned between said threaded cap and said collar to provide a secondary vacuum seal, a gasket being located on the underside of said threaded cap such that said gasket downwardly presses on said lid in closed position, whereby said secondary seal maintains the vacuum if the lid inadvertently becomes loosened, so as to maintain said vacuum during shipping and handling of said container.

2. A container as set forth in claim 1, wherein said pipe is made of PVC.

3. A container as set forth in claim 1, wherein said pipe is made of metal.

4. A container as set forth in claim 1, wherein said pipe has a diameter between three and twelve inches.

5. A container as set forth in claim 1, wherein said pipe has a diameter of three inches.

6. A container as set forth in claim 1, wherein said pipe has a diameter of twelve inches.

* * * * *